US007087006B2

(12) United States Patent
Manico et al.

(10) Patent No.: US 7,087,006 B2
(45) Date of Patent: Aug. 8, 2006

(54) ALBUM LEAF AND METHOD AND APPARATUS FOR MAKING AN ALBUM LEAF

(75) Inventors: Joseph A. Manico, Rochester, NY (US); Frank Jergler, Penfield, NY (US); John R. Squilla, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 92 days.

(21) Appl. No.: 10/385,104

(22) Filed: Mar. 10, 2003

(65) Prior Publication Data

US 2003/0176265 A1 Sep. 18, 2003

Related U.S. Application Data

(62) Division of application No. 09/667,944, filed on Sep. 22, 2000, now Pat. No. 6,761,677.

(51) Int. Cl.
*B31B 1/26* (2006.01)

(52) U.S. Cl. ..... 493/405; 493/397; 493/424; 493/427; 493/434

(58) Field of Classification Search ..... 493/397, 493/399, 480, 449, 457, 405, 454, 940, 458, 493/442, 434, 427, 424; 280/728.1, 743.1
See application file for complete search history.

(56) References Cited

U.S. PATENT DOCUMENTS

| | | | | |
|---|---|---|---|---|
| 4,720,733 | A * | 1/1988 | Ohtake et al. | 355/50 |
| 5,338,282 | A * | 8/1994 | Ferrone | 493/342 |
| 5,791,692 | A | 8/1998 | Manico et al. | |
| 5,839,762 | A * | 11/1998 | Ho-Chou | 281/38 |
| 5,842,964 | A | 12/1998 | Huber et al. | |
| 5,957,502 | A | 9/1999 | Manico et al. | |
| 6,004,061 | A | 12/1999 | Manico et al. | |
| 6,030,329 | A * | 2/2000 | Chen | 493/197 |
| 6,435,562 | B1 * | 8/2002 | McIntyre et al. | 283/67 |

* cited by examiner

*Primary Examiner*—Sameh H. Tawfik
(74) *Attorney, Agent, or Firm*—Thomas J. Strouse

(57) ABSTRACT

An apparatus and method for automatically folding a sheet of media, for example, a photographic paper about a fold line, such that a album page is formed. The photosensitive media has images only on one side. A heat activated adhesive sheet is provided between the sides of the photographic paper during folding. The adhesive sheet when exposed to heated and pressure rollers, will cause the sides of the photographic media to be secured to form a single album page.

1 Claim, 12 Drawing Sheets

ALBUM LEAF AND METHOD AND APPARATUS FOR MAKING AN ALBUM LEAF

CROSS-REFERENCE TO RELATED APPLICATIONS

This is a divisional of application Ser. No. 09/667,944, filed Sep. 22, 2000, now U.S. Pat. No. 6,761,677; entitled ALBUM LEAF AND METHOD AND APPARATUS FOR MAKING AN ALBUM LEAF, in the names of Joseph A. Manico, et al.

Reference is made to commonly assigned, copending applications U.S. Ser. No. 10/385,280 entitled ALBUM LEAF AND METHOD AND APPARATUS FOR MAKING AN ALBUM LEAF, in the names of Joseph A. Manico, et al; U.S. Ser. No. 10/385,272 entitled ALBUM LEAF AND METHOD AND APPARATUS FOR MAKING AN ALBUM LEAF, in the names of Joseph A. Manico, et al; and U.S. Ser. No. 10/385,279 entitled ALBUM LEAF AND METHOD AND APPARATUS FOR MAKING AN ALBUM LEAF, in the names of Joseph A. Manico, et al all filed concurrently herewith.

FIELD OF THE INVENTION

The present invention is directed to an apparatus and method for automatically folding a sheet of imaging media, for example a photographic paper, about a fold line such that an album page is formed. The imaging media has images only on one side. A heat activated adhesive sheet is provided between the sides of the imaging media during folding. The adhesive sheet when exposed to heated and pressure rollers will cause the sides of the imaging media to be secured to form a single album page.

The present invention relates to a method and apparatus for making an album leaf, preferably out of photographic print media or digital thermal imaging media.

BACKGROUND OF THE INVENTION

In a typical photofinishing lab, photographic prints are made using a mini-lab or a high volume printer. In a high volume printer the prints are produced on a roll of photographic paper whereas in a mini-lab the prints may be made on cut sheets or from a roll of photographic paper that is cut into individual prints or cut sheet output from a digital thermal printer. It is known from U.S. Pat. Nos. 6,004,061; 5,957,502; and 5,791,692 that album pages can be made by folding a cut sheet of material such as photographic paper and adhesively securing the folded sides together. While the technique of folding the sheet produces an excellent product, there is a need to be able to make photographic album pages in a high volume, low cost environment. In particular, there is a need to produce album leafs from photographic print media produced either by high speed photographic printers, mini-labs or digital thermal printers.

SUMMARY OF THE INVENTION

In the present invention there is provided a method for automatically making an album leaf, comprising the steps of:

providing an image bearing sheet having an image bearing side having a first image section and a second image section separated by a fold line;

folding the image bearing sheet so as to form a semi-folded cut sheet;

placing an adhesive sheet within the semi-folded cut sheet so that a leading edge of the adhesive sheet is substantially aligned with the fold line; and folding the semi-folded cut sheet having the adhesive sheet folded so as to form an album leaf.

The present invention will be more clearly understood and appreciated from a review of the following detailed description of the preferred embodiments and appended claims, and by reference to the accompanying drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
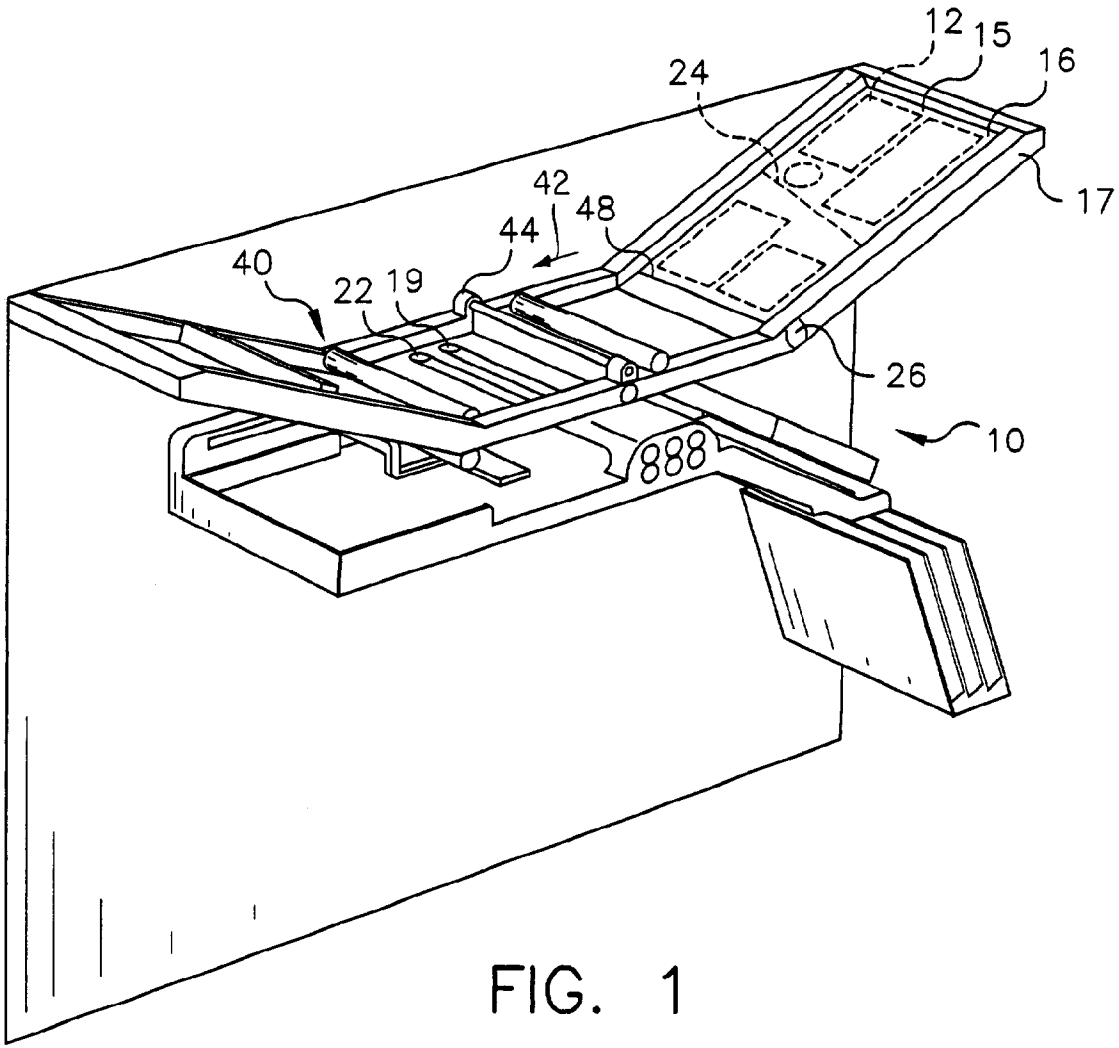
FIG. 1 illustrates an elevation view of an apparatus made in accordance with the present invention.

Referring to FIG. 1 there is illustrated an apparatus 10 made in accordance with the present invention and FIGS. 2–10 illustrates in sequence the various stages of folding a cut sheet to form an album leaf made in accordance with the present invention. The apparatus 10 includes a first supply of a media 12 (see FIG. 9) having an image bearing side 14 and a backside 15. The backside 15 typically being a non-image bearing side. In the particular embodiment illustrated the supply of media 12 comprises a plurality of cut sheets 16. The plurality of cut sheets 16 are placed in supply bin 17.

Figure 9:
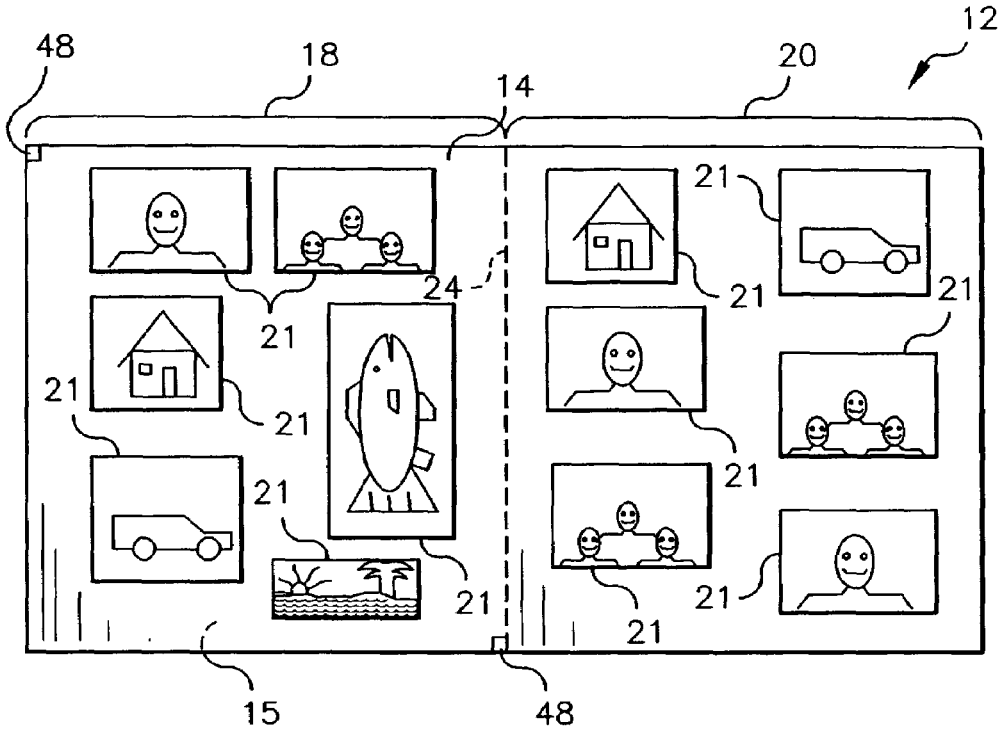
FIG. 9 is plan view of a sheet of media which is to be folded by the apparatus of FIG. 1 to make an album leaf in accordance with the present invention.

Referring to FIG. 9 there is illustrated one of the cut sheets 16. The image bearing side 14 of sheet 16 has been printed thereon so as provide a first image section 18 and a second image 20 in which images 21 of various sizes have been provided. It is of course to be understood that any desired images, text or combination thereof may be provided in the image sections 18, 20. In the embodiment illustrated, the cut sheets 16 comprise photographic paper. The image section 18 and second image section 20 are separated by a fold line 24. The images sections 18, 20 will be folded about fold line 24 so a to form an album page as discussed later herein. The fold line 24 is not necessarily a visible line, but simply indicates a line about which the image sections 18, 20 will be folded. In the embodiment illustrated, there is no visible fold line 24, therefore the fold line 24 is shown by dash lines.

Figure 2:
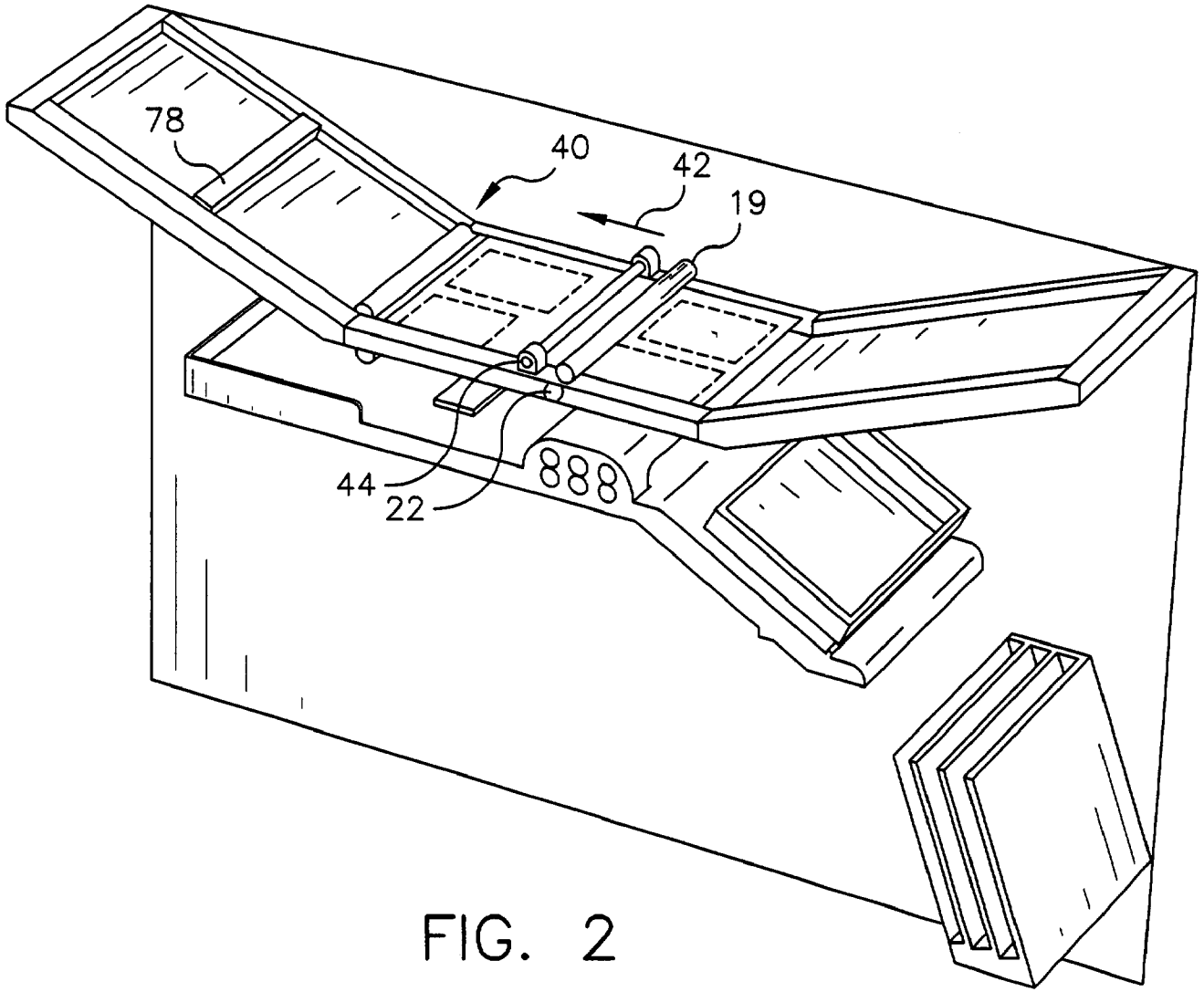
FIG. 2 illustrates the apparatus of FIG. 1 at a different angle in the first step of the folding process.

Referring FIGS. 1, 2 and 3, the cut sheets are placed in bin 17 so that back side 15 is facing upwards. An appropriate transport mechanism 26 is provided for transporting of the sheet 16 from supply bin 17 along processing path 26. In the embodiment illustrated the transport mechanism 26 comprises an air bearing. It is to be understood that any appropriate transport mechanism may be used for feeding individual sheets from bin 17 to the folding mechanism.

The images 21 provided on cut sheets 16 may be provided by any desired printing technique. In the embodiment illustrated the sheets are made have been printed by an optical or digital printer on a web or cut sheet. With respect to web printers, the images are printed on a roll of photographic paper. Position marks, such as hole or printed mark (not shown), have been provided on the roll to designate the beginning and/or end of an image that is to be separated from the roll similar marks may also be used to designate the fold line position. An appropriate sensor and associated cutter is provided may be provided as a part of the printer for separating the images at the designated marks in response. In the embodiment illustrated the roll is cut in individual sheets 16 prior to placement in bin 17.

An individual sheet 16 is advanced from the bin 17 to folding mechanism 40 as indicated by arrow 42 as illustrated in FIG. 2. An optional scoring mechanism 44 is provided between folding mechanism 40 and transport mechanism 26. Due to the generally stiff nature of plastic coated photographic paper, placing a score line along the fold line 24 assists in providing a crisp accurate fold along fold line 24. In the embodiment illustrated the sheet 16 would be stopped at the appropriate position so that the scoring mechanism 44 will properly aligned with the fold line 24. In the present invention this is accomplished by using alignment mark 48 provided on sheet 16 as best seen by reference to FIG. 9. The alignment mark 48 would be formed by the printer that printed the images on sheet 16. A sensor 49 in scoring mechanism 44 would be provided for sensing mark 48 and stopping movement of sheet 16 by the roller 19, 22 that moves sheet 16 from bin 17 to the folding mechanism 40. At least one of the rollers 19, 22 is connected to a drive source, such a motor. A computer or other appropriate controller is provided for controlling the drive sources and movement of the drive rollers 19, 22. After optional scoring, the sheet 16 is transported to folding mechanism 40.

Figure 3A:
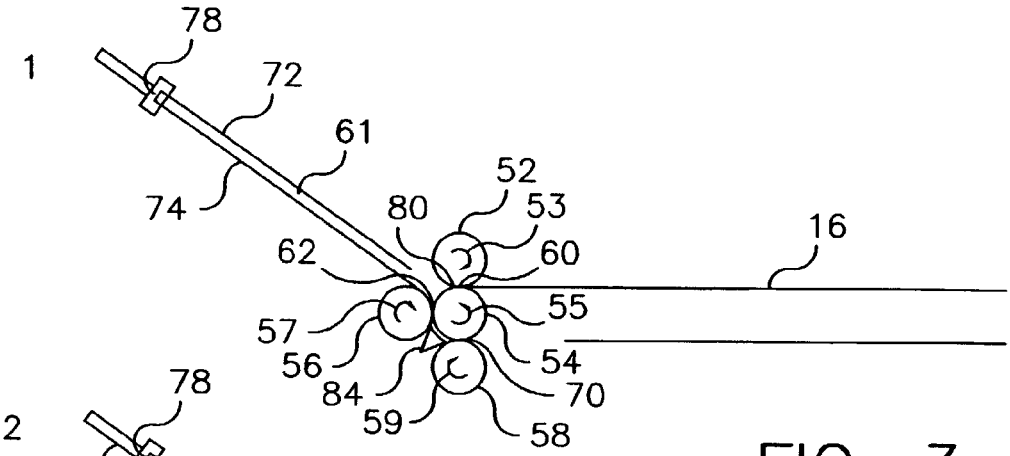
FIG. 3*a* is a schematic diagram of the folding mechanism of the apparatus of FIG. 1 showing the first step in the operation of the folding mechanism.
Figure 3B:
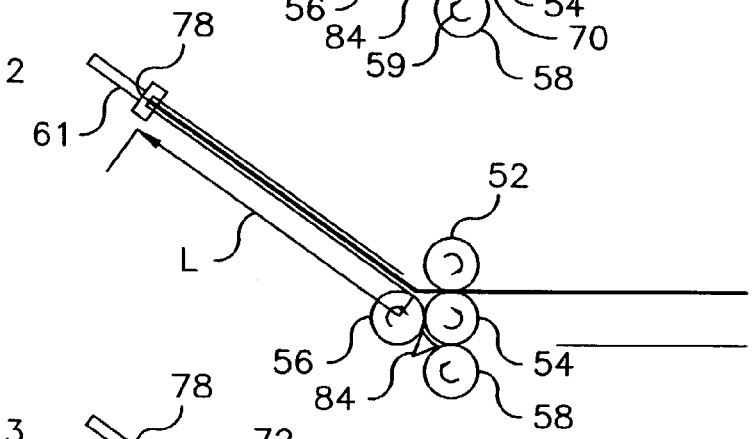
FIG. 3*b* is a schematic diagram of the folding mechanism of the apparatus of FIG. 1 showing the next step in the operation of the folding mechanism after the step illustrated in FIG. 3*a;*
Figure 3C:
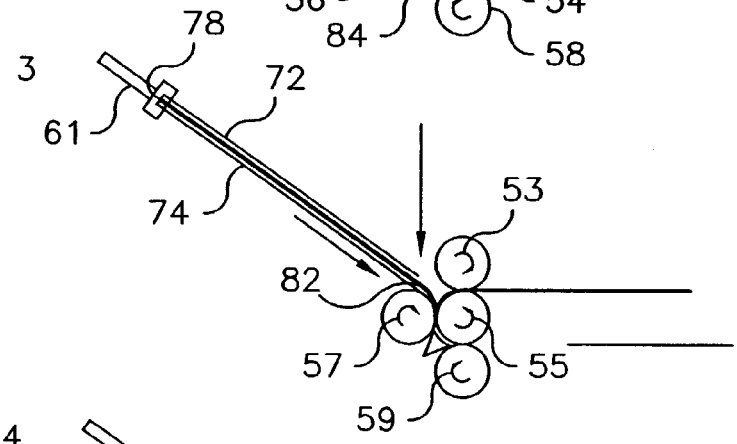
FIG. 3*c* is a schematic diagram of the folding mechanism of the apparatus of FIG. 1 showing the next step in the operation of the folding mechanism after the step illustrated in FIG. 3*b;*
Figure 3D:
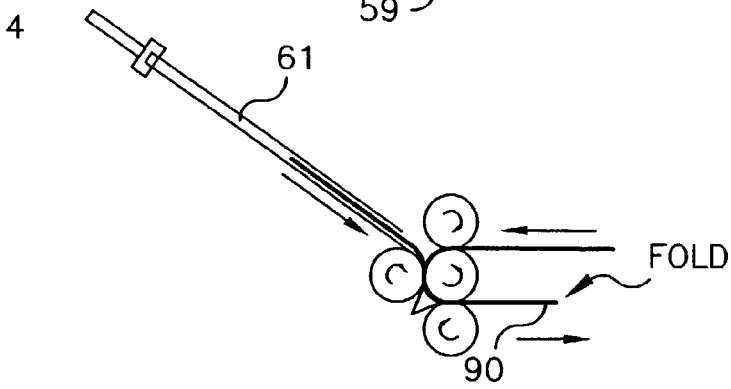
FIG. 3*d* is a schematic diagram of the folding mechanism of the apparatus of FIG. 1 showing the next step in the operation of the folding mechanism after the step illustrated in FIG. 3*c;*

The folding mechanism 40 is of the slam fold type such as disclosed in U.S. Pat. No. 5,842,964. An example of a commercially available slam folder is the Baumfolder 714XLT sold by the Baumfolder Corporation of Sidney, Ohio. Referring to FIGS. 3*a* to 3*d* there is illustrated a cross sectional view of the folding mechanism 40 in the sequential steps of folding a cut sheet 16. The folding mechanism 40 comprises a plurality of rollers, 52, 54, 56 and 58 and pocket 61. The rollers 52, 54, 56 and 58 each rotate in the directions indicated by the associated arrows 53, 55, 57, and 59, respectfully. Rollers 52 and 54 are position to form a first nip 60 where the sheet initially fed. Rollers 54 and 56 are positioned so as to form a second nip 62 where the initial folded end of the sheet 16 is next fed. Rollers the rollers 54 and 58 are positioned so as to form a third nip 70 and so that the initially folded section of the cut sheet 16 will pass there through and out of the folding mechanism 40. The pocket 61 has a rectangular cross sectional configuration which is slightly larger than the cross section of sheet 16 best illustrated by FIG. 14. The pocket 61 comprises a top panel 72 bottom panel 74 and a pair of side panels 76 (see FIGS. 1 and 2) and an adjustable back stop wall 78. The adjustable back stop wall 78 can be used to adjust the size of pocket 61 and thus control the location of the fold. Rollers 52 and 54 drive sheet 16 in to pocket 61 as illustrated by FIGS. 3*a* and 3*b*. The length L of the pocket 61 is selected with respect to a predetermined relationship with respect to the size of sheet 16 so that the folding will occur at the fold line 24. The rollers 52, 54 are always engaged driving sheet 16 into pocket 61. When the leading edge 80 of the sheet 16 contacts the back stop wall 78 (see FIG. 3*b*), the continued driving of rollers 52, 54 causes a leading fold end 82 to formed in sheet 16 at the fold line 24 and cause sheet 16 to travel toward the second nip 68 as illustrated by FIG. 3*c*. The initially fold area 87 of the sheet 16 is driven toward rollers 54 and 56. Once the leading fold end 82 of the sheet 16 is caught by the nip 68 between rollers 54 and 56 this cause the area 87 to be driven to nip 70 between rollers 56 and 58 as shown by FIG. 3*d*. A guide member 84 positioned between rollers 56 and 58 assists in directing the initially folded section 86 of sheet 16 toward nip 70. The leading fold end 82 is then drawn through the rollers 52, 54, 56 and 58 as illustrated by FIGS. 3*a*–3*d* causing the sheet 16 to be folded about fold line 24 so as to form a semi-folded album leaf 90. For the purposes of the present invention a semi-folded album page shall mean a sheet 16 that has been folded about the fold line so as to form a crease along the fold line 24 but not yet fully folded. Typically this is when the sheet 16 has been folded such the first and second image sections 18, 20 form an angle $\alpha$ there between about 5 and 90 degrees, preferably between 10 and 45 degrees.

Figure 4:
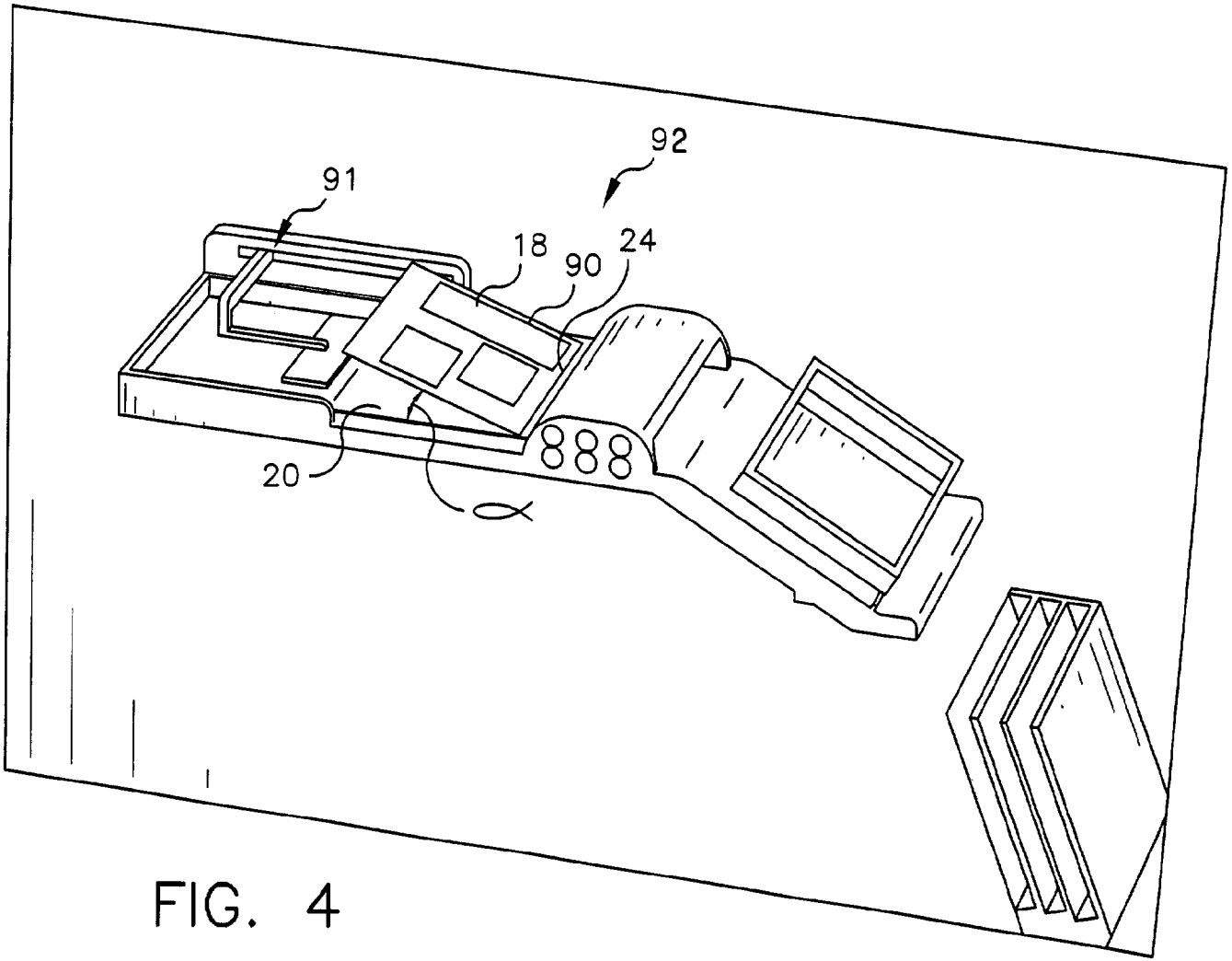
FIG. 4 illustrates an enlarged portion of the apparatus of FIG. 1 in the next step of making an album leaf in accordance with the present invention after the step of FIG. 3*a;*
Figure 5:
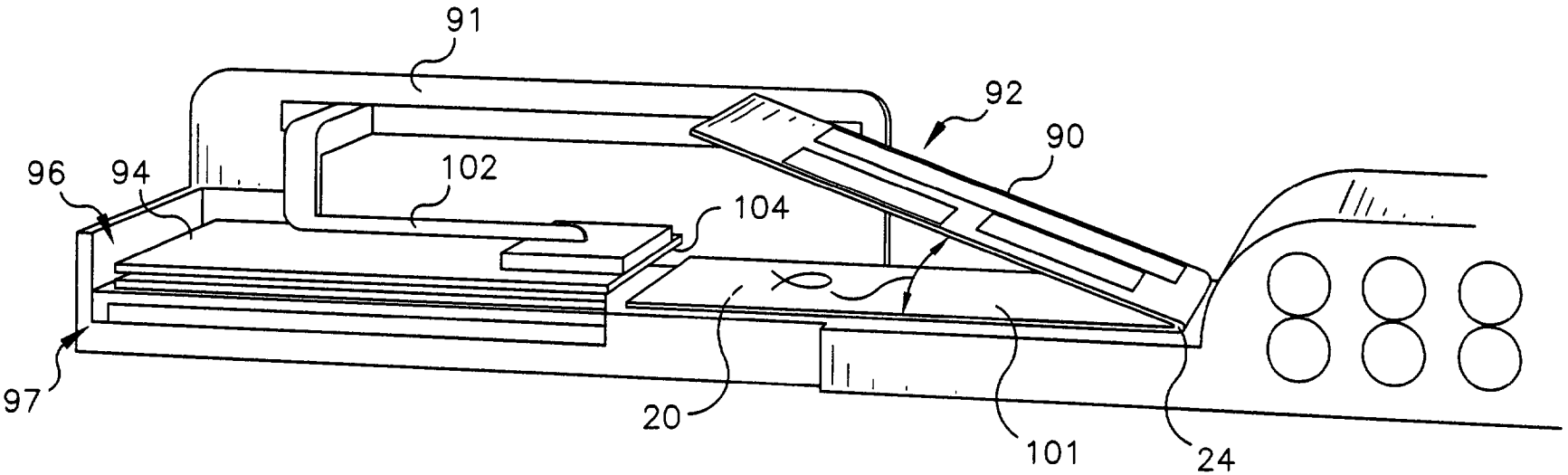
FIG. 5 illustrates an enlarged portion of the apparatus of FIG. 1 in the next step of making an album leaf in accordance with the present invention after the step of FIG. 4.
Figure 6:
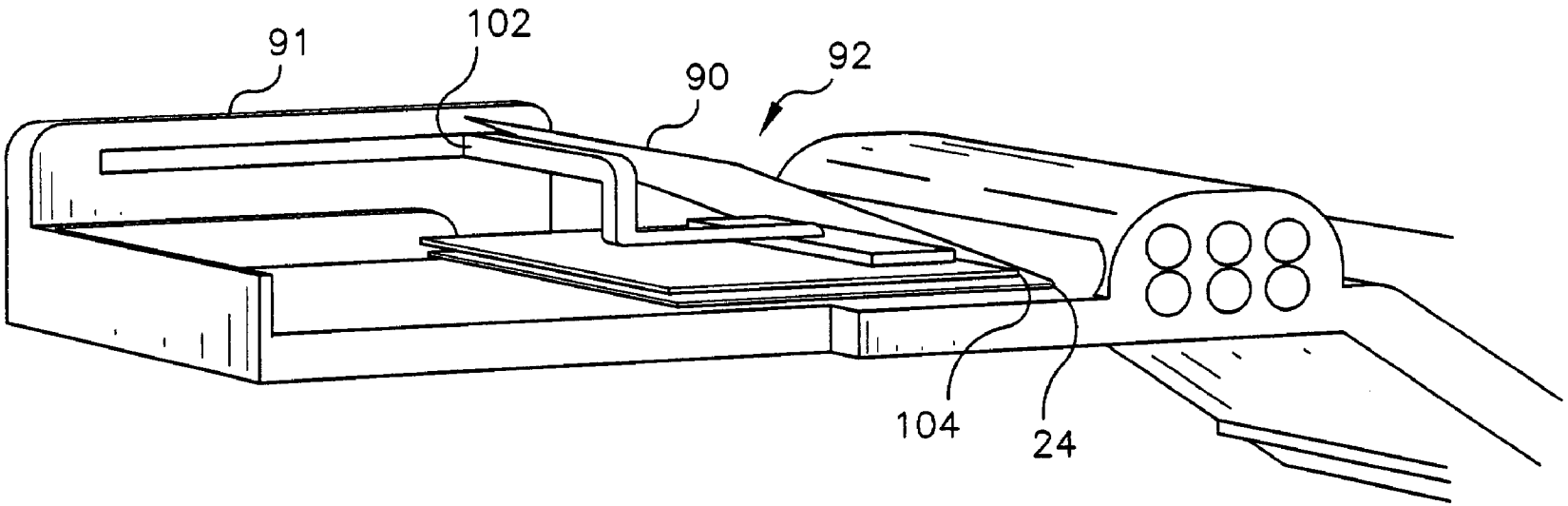
FIG. 6 illustrates an enlarged portion of the apparatus of FIG. 1 in the next step of making an album leaf in accordance with the present invention after the step of FIG. 5.

As illustrated by FIGS. 4–6 the semi-folded album leaf 90 is transport to an adhesive delivery station 92 where an adhesive is placed within the semi-folded album leaf for permanently securing the image sections 18, 20 together. In the embodiment illustrated an adhesive delivery mechanism 91 is provided for placing an adhesive sheet 94 in to the semi-folded album leaf 90 at station 92. The adhesive delivery system 91 includes a first supply 96 of an adhesive media placed in supply bin 97. In the particular embodiment illustrated, the adhesive media is provided in the form of a plurality of cut sheets 94. The adhesive media used may be of any desired type that will allow the adhesion of the semi-folded album leaf 90. In the particular embodiment illustrated the adhesive cut sheet is Kodak Type 2 Dry Mount Tissue or Seal Colormount® Dry Mount Tissue. These particular adhesive tissues are designed to be heat activated. A sheet 94 is taken from a supply 96 of bin 97 is placed in the folded area 101 provided in the semi-folded album leaf 90. In the embodiment illustrated the delivery system 91 comprises a vacuum pick-up arm 102 that is used to lift one of the cut adhesive sheets 94 from the supply 96 of sheets 94 in supply bin 97 and is placed into the semi-folded album leaf 90. The vacuum pick-up arm 102 is initially positioned at a pick-up position as illustrated by FIG. 4. A vacuum is applied to arm 102 such that the top adhesive sheet 94 is picked up from supply 96. The arm 102 is then moved such that the leading edge 104 of the adhesive sheet 94 is placed at or just short of the fold line 24 as illustrated by FIG. 6. Once the sheet 94 has been positioned with the semi-folded album leaf 90, the cut adhesive sheet 94 is released and the arm 102 is retracted back to the pick-up position, see FIG. 5, leaving the adhesive sheet 94 within the semi-folded album leaf 90.

Figure 7:
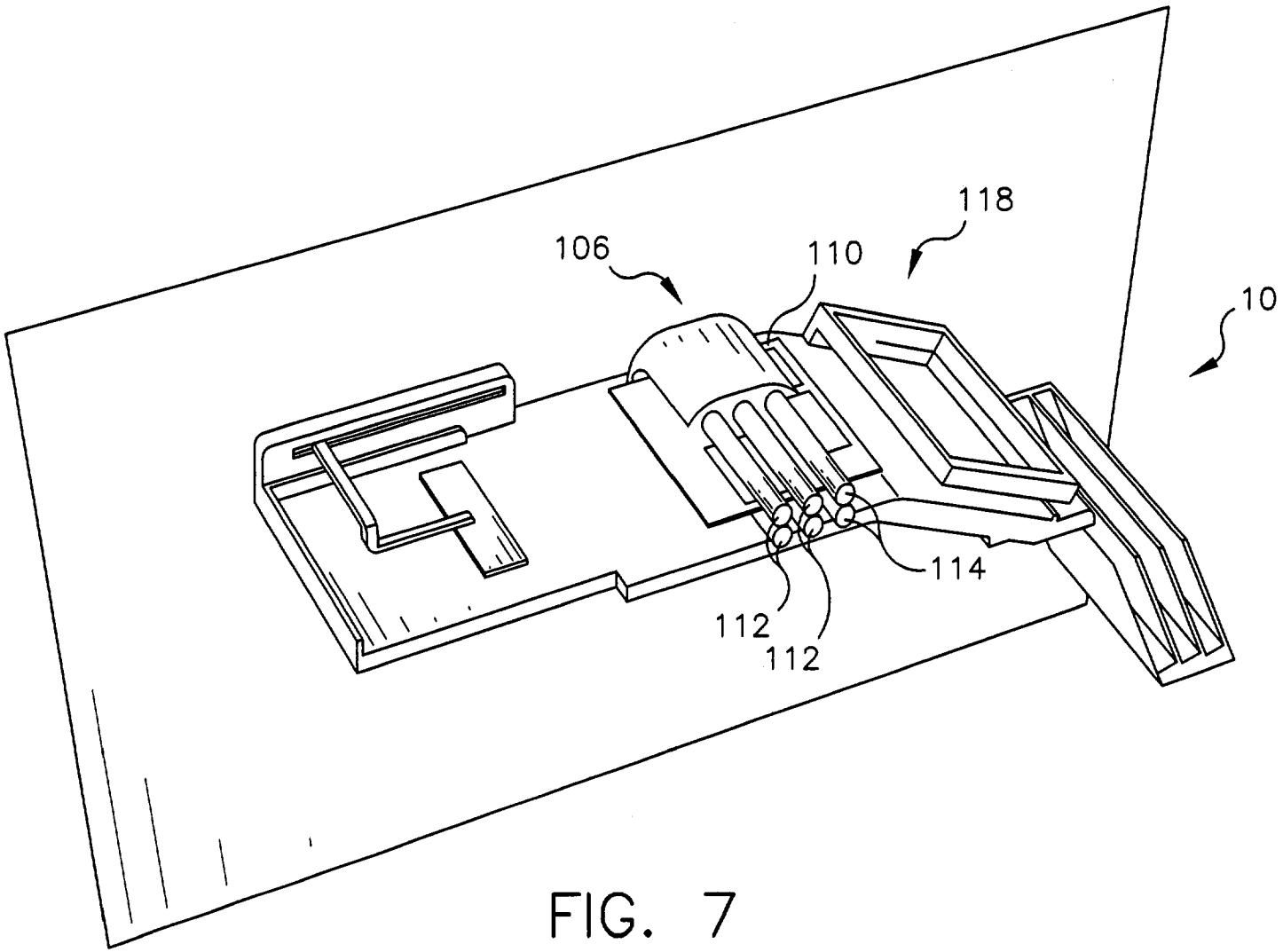
FIG. 7 illustrates an enlarged portion of the apparatus of FIG. 1 in the next step of making an album leaf in accordance with the present invention after the step of FIG. 6.

The semi-folded album leaf 90 is then completely folded about the adhesive album leaf 90 and sealed at sealing station 106 as illustrated by FIGS. 6 and 7 so as to form album leaf 110. In the particular embodiment illustrated, the adhesive used in adhesive sheet 94 which does not form a permanent bonded until the application of heat and a small amount of pressure. Therefore, the leaf 110 is passed through a plurality of heating pressure roller 112 for permanently sealing of leaf 110. The degree and amount of heat and pressure will vary on a variety of factors such as, the dwell time or the rate of movement through the heated rollers. Also if the imaging media is paper or plastic based and the thickness of the imaging media will affect the required temperature and pressure. The amount of heat and pressured applied is such so as not to cause perceivably damage or affect the images on the leaf 110. In the embodiment illustrated the leaf 110 is passed through sets of heated silicone rollers at a rate of 1.5" per second, set at a temperature of about 160 to 210 degrees F. and a pressure of at least about 30 psi. A pair of cooling rollers 114 is provided so as to cool the leaf 110 after passing through heating silicone rollers 112. It is to be understood that depending upon the type of adhesive being used heat or a separate pressure application may not be needed.

Figure 8:
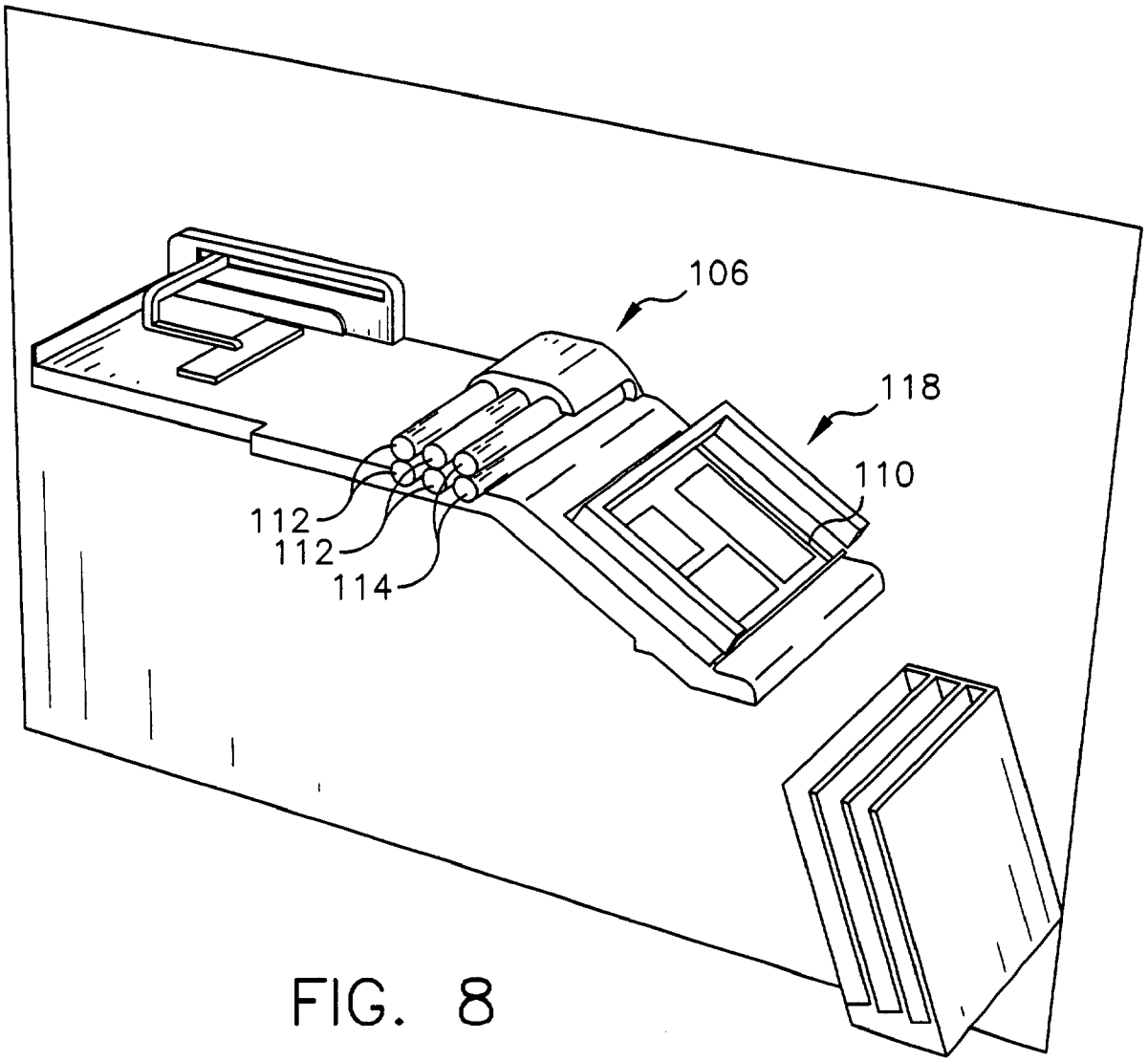
FIG. 8 illustrates an enlarged portion of the apparatus of FIG. 1 in the next step of making an album leaf in accordance with the present invention after the step of FIG. 7.
Figure 10:
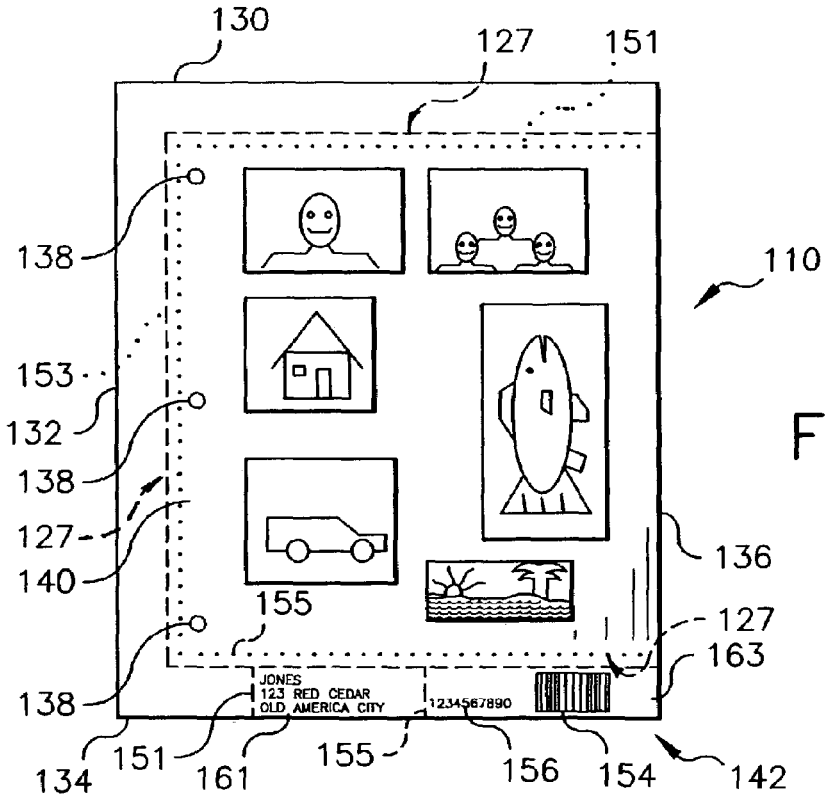
FIG. 10 is plan view of the album leaf made according to the present invention prior to the final finishing operation.
Figure 11:
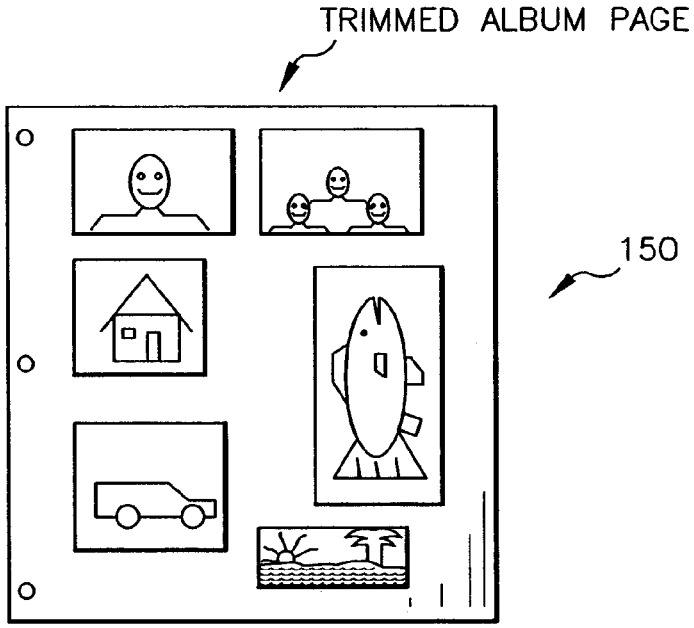
FIG. 11 illustrates the finished album leaf that is trimmed off the leaf of FIG. 10 to produce the finished album leaf.

The leaf 110 is then forward from sealing station 106 to a finishing station 118 by the rollers 120, 122 as best illustrated by reference to FIG. 8. Certain finishing operations are provided at the finishing station 118. FIG. 10 illustrates an album leaf 110 prior to being subjected to the trimming operation. In the embodiment illustrated the edges of the leaf 110 are trimmed so as to provide a finished leaf section 150 as illustrated by FIG. 11. FIG. 10 illustrates the trimmed section 123 that is to be removed from the leaf 110. The dot line 127 of FIG. 9 illustrates the outer periphery of the finished leaf section 150 that will be made from leaf 110. Preferably as illustrated, only the cut edges 130, 132, 134 of the leaf 110 are trimmed leaving the folded edge 136 untouched. Additionally the trimmed section cuts through the outer periphery 137 of the adhesive sheet 94, illustrated by the dash line 139, so that the edges of the leaf 150 will be sealed together. Optional holes 138 may be provided in a margin area 140 by a hole punch device (not shown) so that the finished leaf 150 may be placed in a ring binder. Also as illustrated by FIG. 10 an optional ID section 142 may be provided which may include customer order identification information so that the finished leaf 110 can be easily identified with a customer order. Several lines perforations 151, 153, and 155 are provided which forms part of the outer periphery 127 of leaf 150. Lines of perforations 157 and 159 are also provided for providing removable sections 161 and 163 which contains information. It is of course understood that other means may be used for allowing separation of the trim sections 123 from the finished leaf 150. The information may be in the form of a machine readable code 154 and/or in a human readable form 156. The machine readable code 154 can be automatically read by a scanner for later operations, such as associating the finished leaf 150 with the customer/customer order. Once the leaf 110 is associated with the customer order the ID section 142 may be removed by simply tear it off from leaf 110. The information may also include customer address so that ID section as illustrated in section 161 that can be used as an address label. It is of course understood that any desired information may be provided in sections 161, 163 and be used for any desired purpose by the photofinisher, photoservice provider or customer. Since the album pages are typical made by a photofinisher/photoservice provider, the use of the information provided on the trimmed section can be very useful in processing plurality of customer orders. In the embodiment illustrated the section 161 may be used a mailing label and section 163 is used for sorting the finished album leaf with the customer order by the photofinisher.

Figure 14B:
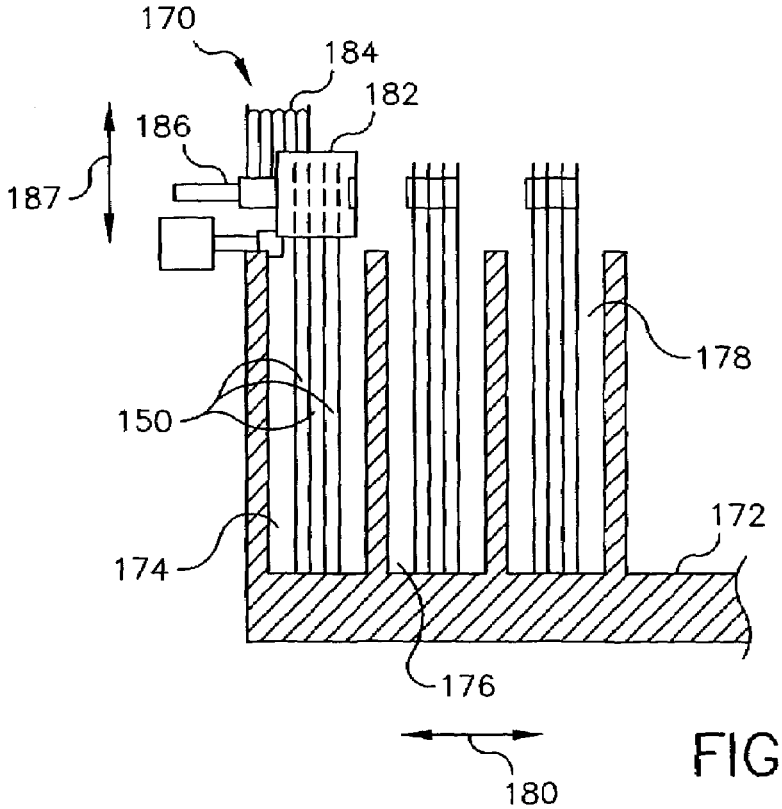
FIG. 14*b* illustrates in greater detail the binding mechanism illustrated in FIG. 14*a*.
Figure 14A:
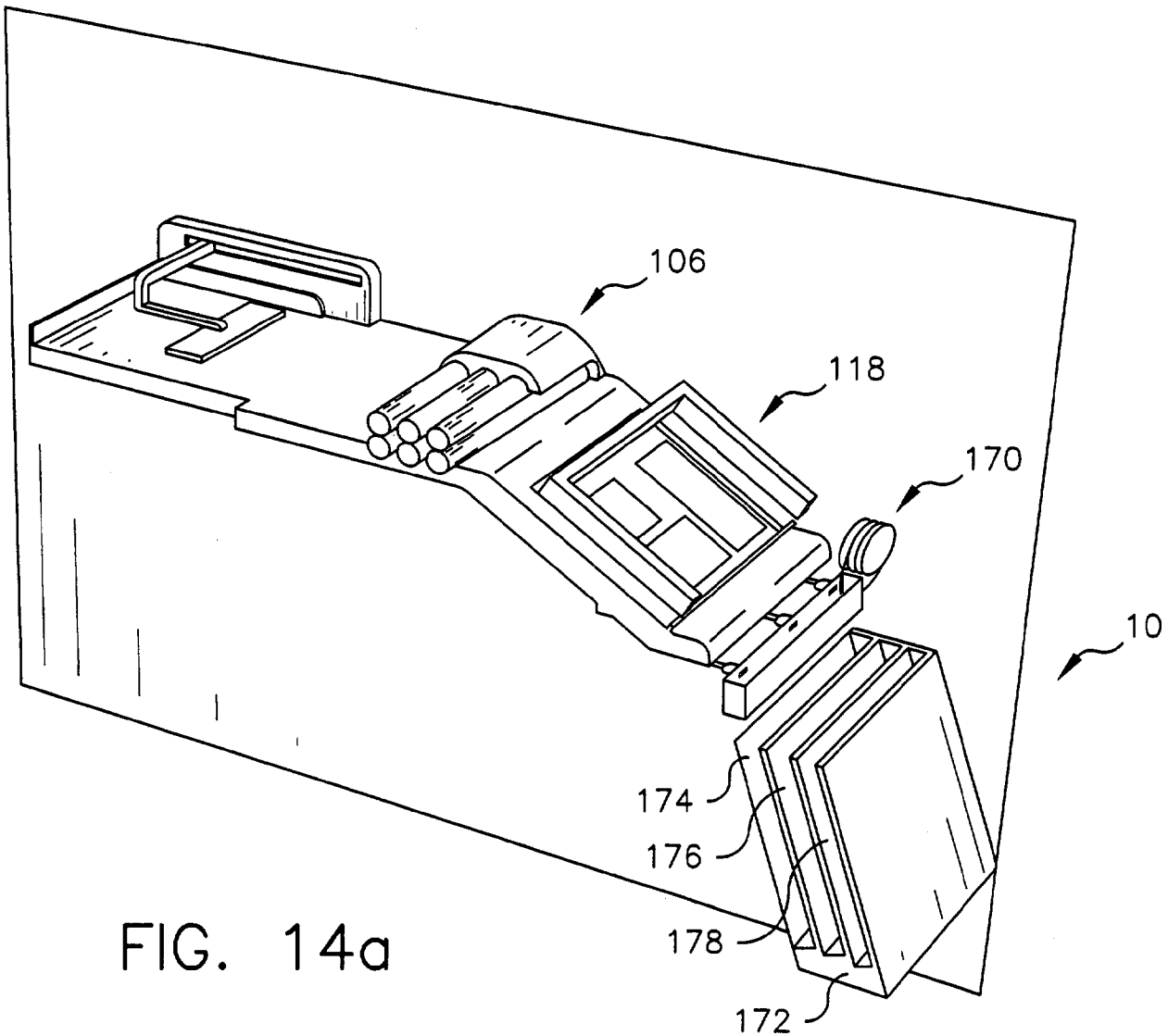
FIG. 14*a* is a view similar to FIG. 8 illustrating a modified apparatus made in accordance with the present invention.

It is of course to be understood that any desired finishing operation may be provided, including but not limited to, the providing of other means for securing the leaf to a book, binder, or binding multiple sheets together forming a booklet, etc. Referring to FIG. 14*a* and 14*b* there is illustrated a modified apparatus 10 made in accordance with the present invention, like numerals indicating like parts and operation. In this embodiment, a binding mechanism 170 is provided for securing together a plurality of leafs 150. FIG. 14*b* illustrated a more detailed illustration of the binding mechanism 170. A movable sort bin 172 is provided having a plurality of receiving sections 174, 176, 178 each capable of retaining a plurality of leafs 150. The sort bin 172 may be moved by and appropriate mechanism and controlled by the same computer that controls apparatus 10. The bin 172 may be moved in the directions indicated by arrow 180 so that the appropriate receiving section of the plurality of receiving sections 174, 176, 178 will be located to receive the leafs 150 from the finishing station 118. In the particular embodiment illustrated the binding mechanism 170 included a stapling mechanism 182 for providing one or more staples for securing a plurality of leafs 150 as illustrated by FIG. 14*b*. In the embodiment illustrated stapling mechanism 182 is designed to provide three staples. A wire supply 184 and cutter (not shown) is provided for supplying material for the stapling mechanism 182. The stapling mechanism 182 is mounted to a movable support 185 for moving the stapling mechanism 182 as indicated by arrow 187. This allow for the movement of the stapling mechanism 182 to a position where it will not interfere with the leafs entering bin 172 and to an engaged position for placing staples into a plurality of leafs placed in one of the receiving sections 174, 176, 178. It is to be understood that any type binding mechanism may be used for binding a plurality of leafs together.

In the embodiment illustrated the media 12 to be folded is provided in cut sheet form. However the present invention is not limited. Alternatively or as an auxiliary source of media to be made into album leafs may be provided in the form a roll which is cut into individual cut sheets by a cutter (not shown) and delivered to the folding mechanism 40.

Figure 12:
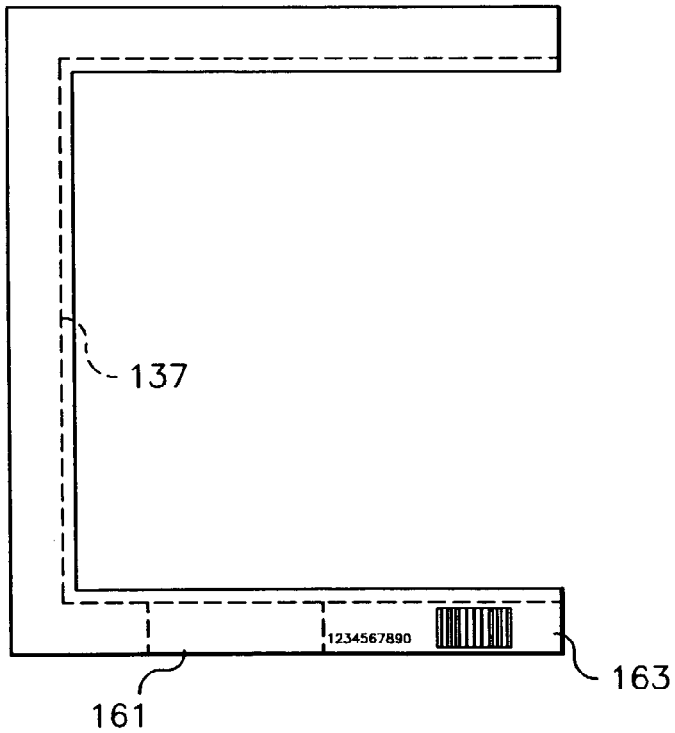
FIG. 12 illustrates the trimmed off portion of the album leaf of FIG. 10.
Figure 13:
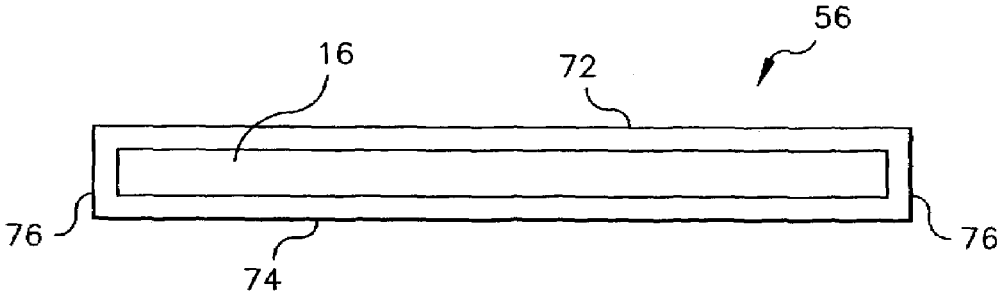
FIG. 13 is a cross sectional of the pocket of the folding mechanism used to form an album leaf of the present invention.

In order to better understand the present invention a description of the operation of apparatus will now be discussed. Referring to FIG. 1 an initial sheet 16 is transported from bin 17 to the folding mechanism 40 where the cut sheet is formed in to a semi-folded album leaf 90. The folding mechanism 40 delivers the semi-folded album leaf to the adhesive delivery station 92 where a cut adhesive sheet 94 is placed within the semi-folded album leaf 90. The adhesive sheet is placed at or just behind the fold line as illustrated by FIG. 6. The shape of the sheet 16 is substantially the same as the folded sheet but is preferably slightly smaller in size so that the adhesive material on adhesive sheet during the sealing operation will not flow out the edges. The album leaf 90 is then passed through the sealing station 106 where heat and pressure is applied followed by cooling by rollers 114. The album leaf 90 is then sent to the finishing station where final finishing operations are applied to the leaf 90 forming a finish leaf 150. There after the finished leaf 150 is placed in the normal return process by the maker of the album leaf 110 for eventual return to the customer. FIG. 11 illustrates the album leaf after the trimmed portion of FIG. 12 is removed. As previously discussed sections 161 and 163 may be used by the processor (photoservice provider) for placing the finished album leaf 150 with the customer order and/or for transporting of the order to the customer.

The same process is used when a roll of media is provided for making of the album leaf except that the roll of media passes through a cutter at the appropriate location for to forwarding to the folding mechanism 40. For example appropriate cutting marks that have been provided on the roll during printing could be used for activating the cutter at the appropriated location and for activating movement of the roll at the appropriate times. The remaining parts of apparatus 10 operate in the same manner as previously discussed.

In the embodiment illustrated the images are provided on the outside of the folded sheet 16. In certain cases the images may be provided on the inside surface which can view through a protective outer layer. The sheet is simply folded such the images can be viewed on the outer surfaces of the album page 110. An example of such a material is the Kodak Professional Duraclear digital display material. Because the images are provided on the inside surface of the sheet, when the sheet 16 is folded is necessary to place an opaque layer behind the image. This can be accomplished by providing an opaque, white, and reflective adhesive sheet 94. This can be accomplished by coating a translucent heat activated adhesive on both sides of an opaque, white, reflective substrate such as dual sided inkjet receiver paper. This would allow the images to be viewed form the outer surfaces of the finished album leaf 110.

The invention has been described in detail with particular reference to certain preferred embodiments thereof, but it will be understood that variations and modifications can be effected within the spirit and scope of the invention.

PARTS LIST

10 apparatus
12 media
14 image bearing side
15 backside
16 cut sheets
17 supply bin
18 first image section
19 driver roller
20 second image section
21 images
22 roller
24 fold line
26 transport mechanism
40 folding mechanism
42 arrow
44 optional scoring mechanism
48 alignment mark
49 sensor
52 roller
53 arrow
54 roller
55 arrow
56 roller
57 arrow
58 roller
59 arrow
60 first nip
61 pocket
62 second nip
68 nip
70 nip
72 top panel
74 bottom panel
76 side panels
78 stop wall
82 leading fold end
87 fold area
90 semi-folded album leaf
91 adhesive delivery mechanism/system
92 station
94 sheet
96 first supply
97 supply bin
101 folded area
102 vacuum pick-up arm
104 leading edge
106 sealing station
110 album leaf/page
112 heating pressure roller
114 cooling rollers
118 finishing station
120 rollers
122 rollers
123 trimmed section
127 dot line
130 cut edges
132 cut edges
134 cut edges
136 folded edge
137 outer periphery
138 holes
139 dash line
140 margin area
142 ID section
150 finished leaf
151 line perforations
153 line perforations
154 machine readable code
155 line perforations
156 human readable code
157 line perforations
161 section
163 section

What is claimed is:

1. A method for automatically making an album leaf, comprising the steps of:

providing an image bearing sheet having an image bearing side having a first image section and a second image section separated by a fold line;

providing a folding mechanism for automatically folding said image bearing sheet so as to form a semi-folded cut sheet such that said first image section and said second image section are spaced apart;

providing a mechanism for automatically placing an adhesive sheet within said semi-folded cut sheet so that a leading edge of said adhesive sheet is substantially aligned with said fold line;

providing a mechanism for automatically folding said semi-folded cut sheet having said adhesive sheet that has been placed within said semi-folded; and providing a trimming mechanism for trimming said folded album leaf cut sheet so as to form an album leaf.

* * * * *

UNITED STATES PATENT AND TRADEMARK OFFICE

CERTIFICATE OF CORRECTION

PATENT NO. : 7,087,006 B2
APPLICATION NO. : 10/385104
DATED : August 8, 2006
INVENTOR(S) : Joseph A. Manico et al.

It is certified that error appears in the above-identified patent and that said Letters Patent is hereby corrected as shown below:

| | |
|---|---|
| Col. 10, lines 3-10 should read | |
| Claim 1, second to last paragraph. | providing a mechanism for automatically folding said semi-folded cut sheet having said adhesive sheet that has been placed within said semi-folded <u>cut sheet so as to form an album leaf</u>; and |
| Claim 1, last paragraph. | providing a trimming mechanism for trimming said folded album leaf [cut sheet so as to form an album leaf]. |

Signed and Sealed this

Fifteenth Day of May, 2007

JON W. DUDAS
*Director of the United States Patent and Trademark Office*